US006011511A

United States Patent [19]

Chuong et al.

[11] Patent Number: 6,011,511

[45] **Date of Patent: *Jan. 4, 2000**

[54] SATELLITE DISH POSITIONING SYSTEM

[75] Inventors: Benson Chuong, San Jose; Charles Barry, Campbell, both of Calif.

[73] Assignee: Samsung Electronics Co., Ltd., Suwon, Rep. of Korea

[ * ] Notice: This patent issued on a continued prosecution application filed under 37 CFR 1.53(d), and is subject to the twenty year patent term provisions of 35 U.S.C. 154(a)(2).

[21] Appl. No.: 08/745,932

[22] Filed: Nov. 7, 1996

[51] Int. Cl.[7] ..... H01Q 3/00

[52] U.S. Cl. ..... 342/359; 343/703

[58] Field of Search ..... 342/359; 343/703

[56] References Cited

U.S. PATENT DOCUMENTS

| | | | |
|---|---|---|---|
| 4,167,738 | 9/1979 | Kirkendall | 343/703 |
| 4,796,032 | 1/1989 | Sakurai et al. | 342/359 |
| 5,376,941 | 12/1994 | Fukazawa et al. | 342/359 |
| 5,424,750 | 6/1995 | Akisada | 342/359 |
| 5,519,405 | 5/1996 | Matsubara et al. | 342/359 |
| 5,587,717 | 12/1996 | Jang | 342/359 |
| 5,797,083 | 8/1998 | Anderson | 455/25 |

*Primary Examiner*—Theodore M. Blum
*Attorney, Agent, or Firm*—Kenneth L. Sherman, Esq.; Sherman & Sherman; Jeffrey P. Aiello, Esq.

[57] ABSTRACT

A method and apparatus for adjusting the position of an antenna to improve reception at a television includes a signal generator which measures the signal strength received by the antenna. The signal generator sends a low frequency coded signal to a display visible to a person who is adjusting the antenna. The display provides a quantitative indication of the signal strength to the installer of the antenna, allowing precise adjustments to be made in accordance with the displayed value. The signal generator provides the coded signal to the display via the same cable used to carry the received signals from the antenna to a receiver, such as a set-top box.

1 Claim, 2 Drawing Sheets

SATELLITE DISH POSITIONING SYSTEM

TECHNICAL FIELD OF THE INVENTION

The present invention is related to the field of satellite dish receivers, and more particularly, to the positioning and orienting of satellite dish receivers.

BACKGROUND

The Digital Satellite Service (DSS) has become increasingly popular among consumers, permitting viewers in sparsely populated or mountainous areas high quality access to television programs from around the world. Residents of areas too distant from a ground transmitter to receive high quality television signals, residents of areas where delivery of television signals by cable is impractical, and residents of mobile homes and recreational vehicles moving from one location to another, can receive television programs wherever they happen to be. Television transmitters operating in the DSS system provide coded digital signals via a satellite to receivers located within the field of view of the satellite. The satellite or satellites in the DSS system retransmit a signal from one or more earth stations to a large number of receiving earth stations. Satellites in geo-stationary orbit, or a series of satellites passing through positions over the United States, can provide continuous television programming to viewers, anywhere in the country.

DSS receivers generally are low-cost, simple to connect, small and easily transportable parabolic antennas that consumers mount on a residential rooftop or recreational vehicle. To set up a DSS antenna, a viewer determines the defined elevation and azimuth angles from the antenna location to the satellite. The coarse directional angles to the satellite in the satellite's field of view from any point on the earth can easily be determined by a customer setting up a receiver location. Once the angles are determined, the viewer points the antenna toward an approximate point in the sky in the neighborhood of the satellite, and begins the adjustment or "fiddling" process of moving the antenna in slight movements until the reception at the television is clear. In the case of a mobile receiver unit, this process must be repeated at each location. However, because different viewers live in different parts of the country, or can move from one place to another, assisting a typical consumer with correct and accurate pointing of an antenna toward a satellite has become a necessary element of the DSS system.

The elevation and azimuth angles are available for each longitude and latitude, as well as for each zip code. Hence, a dish installer can usually point the antenna in the general direction of the satellite. However, the antenna may still be difficult to position accurately, for a number of reasons. Fine angle discrimination is difficult, due to the measurement errors of determining one's precise longitude and latitude, the range of locations that may be within a zip code, and even mechanical bending of the structure supporting the antenna. Mechanical bending of the structure causes an error that is difficult to measure and correct, since it may introduce a roll component as well as an unmeasured azimuth and elevation angle. The viewer may also create orientation errors, for example by installing the antenna support structure on a roof that is not completely horizontal, or, if the antenna is mounted on a recreational vehicle, by parking on an uneven site. If the base of the antenna structure is not placed on a truly horizontal stable support, required elevation angles, such as "42 degrees above the horizontal", are exceedingly difficult to implement.

In the DSS system, the antenna is generally coupled to a receiver via a cable. The receiver then provides the signal to the television or other viewing monitor. To accommodate different viewer's locations, for example mountainous or urban locations with large structures that may interfere with line-of-sight reception from the satellite, the cable provided is long enough to allow the antenna and the receiver/television to be some distance apart. To orient the antenna properly, therefore, the viewer sets the antenna in a selected location, directs the antenna toward the general orientation angles (azimuth and elevation) as reported for the location of the antenna. Once the antenna is set in the location, the viewer must then make minor adjustments to the antenna orientation, often by only fractions of a degree, to receive a clear video image. Unfortunately, the physical distance between the television and the antenna make this precision adjustment difficult. From the vantage point of the antenna, the television is remote, i.e. too far to see clearly, and the line of sight is generally interrupted by walls and other objects. Generally, the viewer has three options for adjusting the finer gradations in the orientation of the antenna: he can make repeated trips between the antenna and the television; he can enlist the aid of another person to watch the television and report orally on how clearly the signal is being received, either by calling out loudly enough to hear or by using a two-way radio (i.e., a walkie-talkie); or the viewer can hire an installation service. These solutions all have problems, however. The repeated trips between the television and the antenna, for example, can take a very long time and are frustrating. The second solution is not satisfactory either due to the difficulty in describing the clarity of a picture in measurable terms. Also, many people live alone or in remote areas, and one of the most important features of DSS is its ability to provide clear television pictures to remote areas too sparsely populated to attract cable companies. The third solution can be prohibitively expensive, and also may be unavailable to people living in remote areas.

A commercially available system that attempts to resolve these problems employs a single blinking light at the antenna to indicate signal strength. As the dish is moved, changing the signal strength, the receiver connected to the antenna provides a signal up the cable to the light at the antenna. This signal causes the light to blink slowly to indicate low received signal strength, and faster blinking to indicate higher signal strength. When the light is steady, the antenna is supposed to be positioned correctly.

The problem with this known system is the non-intuitive nature of the signal strength indication afforded by the blinking light. As one moves the antenna in minute increments, it is difficult to accurately judge whether an adjustment causes the light to blink at a slightly faster frequency, or a slightly slower frequency. Further, once the antenna is adjusted so that the light is steady, there may still be some adjustment that could be made to improve the signal reception to a maximum level.

Due to the versatility of the DSS devices, however, satellite antennas and receivers are very popular, notwithstanding these difficulties. Nevertheless, the difficulties inherent in the initial orientation of the antenna upon setup are problematic to many viewers.

SUMMARY OF THE INVENTION

There is a need for a method and apparatus for informing an installer, in a more precise manner than in the prior art, of the quality of the signal received by the receiver coupled to the antenna while the installer is positioning the antenna. The indication should provide quantitative information regarding the signal strength, so that the installer can estimate the amount of correction angle to apply to the antenna.

A method and apparatus are taught for positioning a satellite antenna to maximize the strength of the received satellite signal. A signal generator determining the strength of signals received from the antenna provides a strength signal to a display at a positionable antenna, where the display assists correct and accurate pointing of the antenna toward a satellite.

The foregoing and other features, aspects and advantages of the present invention will become more apparent from the following detailed description of the present invention when taken in conjunction with the accompanying drawings.

DETAILED DESCRIPTION

Figure 1:
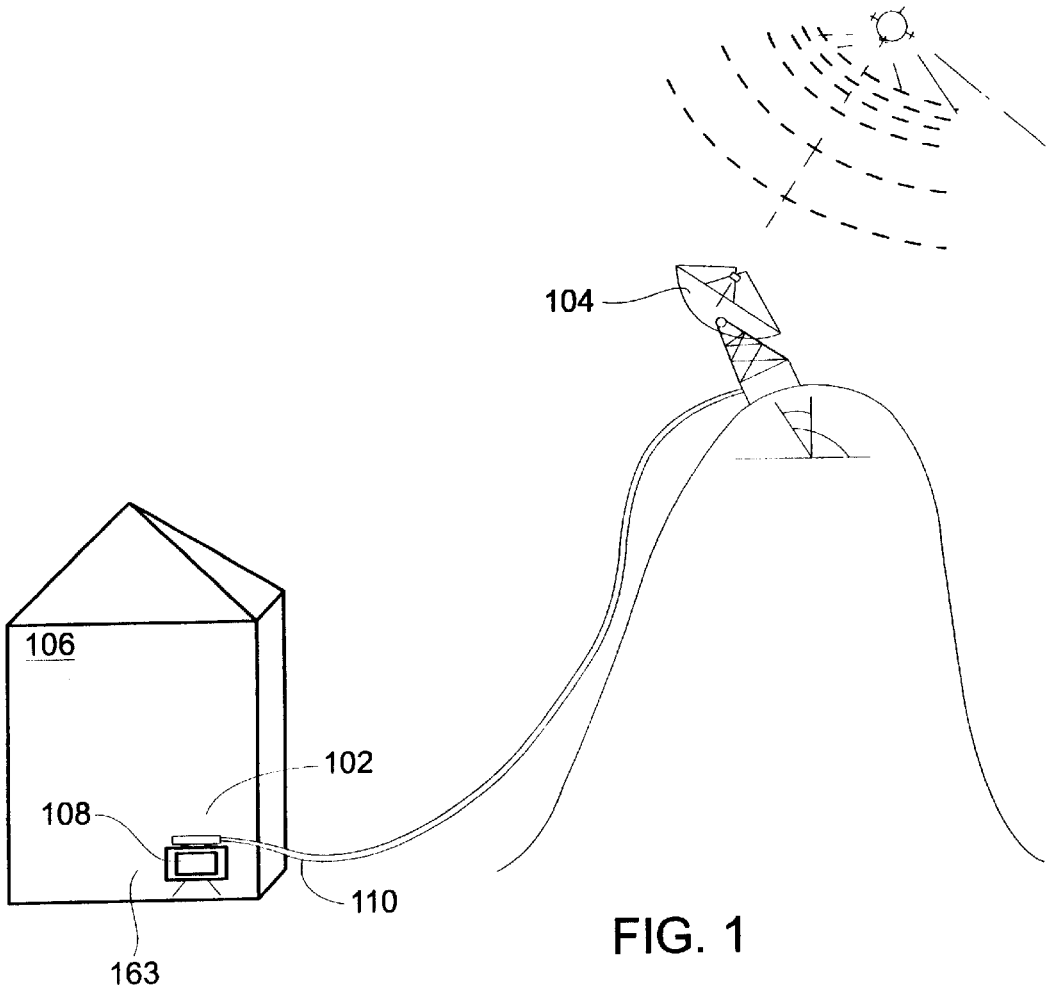
FIG. 1 is a schematic depiction of a DSS system in the installation environment.

The present invention is described with reference to various embodiments. However, it will be readily apparent to one skilled in the art upon reference to the specification that variations to the described embodiments are possible without departing from the invention. Furthermore, it will be apparent that the invention may be practiced with technologies other than the DSS system of satellite antennas. The description of embodiments using the DSS system is presented by way of example, to aid in the understanding of the invention, and not by way of limitation.

A DSS system is schematically depicted installed at a home. Structure 106 is a home or private residence, an apartment building, a hotel, or a non-residential location such as a restaurant. A set-top box 102 serving as the signal receiver is located within the structure 106. The set-top box 102 receives the signal from an antenna 104 and conditions the signal for display by the television 108.

The set-top box 102 is coupled to the antenna 104 via a coaxial cable 110. The antenna 104 is located exterior to the structure 106 to provide a clear line of sight to a satellite, and can be mounted on the structure 106 itself. The antenna 104 transduces a radiated electromagnetic signal, received from a satellite in orbit about the earth, to a signal in the cable 110.

In the embodiment depicted in FIG. 1, the set-top box 102 receives a number of frequency-multiplexed channels of television programming from the antenna 104 via coaxial cable 110, which extends from the interior of the structure 106 to the antenna 104. The set-top box 102 contains a channel selector that is a demultiplexer for selecting a particular channel from the channels carried by the cable 110, the selected channel being presented on the television set 108 coupled to the set-top box 102.

Figure 2:
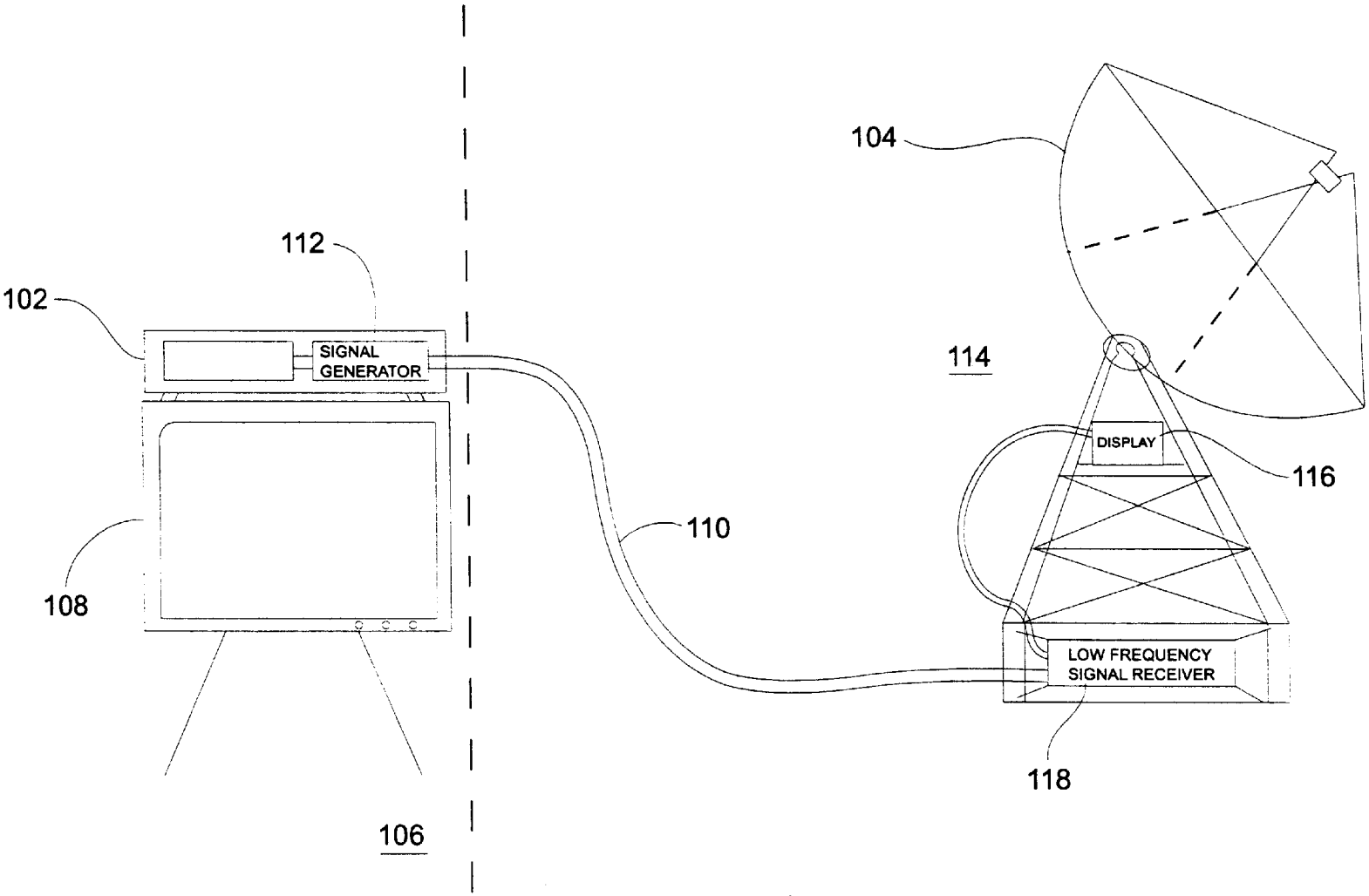
FIG. 2 is a schematic depiction of the DSS system constructed in accordance with an embodiment of the present invention.

FIG. 2 depicts a DSS system constructed in accordance with an exemplary embodiment of the present invention. The set-top box 102 has an associated signal generator 112. In certain embodiments, the signal generator 112 is within the same enclosure as the other components of the set-top box 102; and in other embodiments it is located external to the enclosure. The signal generator 112 has a conventional signal strength detector that measures the overall signal strength of the signal from the antenna 104. The signal generator 112 produces a coded signal indicative of the signal strength, and provides the coded signal over the cable 110 to the antenna 104. In certain embodiments, the coded signal is a low-frequency signal operating in a band not used for the primary signals from the antenna 104 to the set-top box 102. By using a different band for the coded reception strength signal, the embodiment can carry both the primary and the reception strength signals over the same cable.

Although in the exemplary embodiment of FIG. 2 the signal generator transmits a low frequency signal over the same cable 110 that carries the received signals from the antenna 104 to the set-top box 102, other types of signals and transmission media are employed in different embodiments of the present invention. For example, the reception strength signal need not be carried on the same medium as the transduced signal (e.g., video images).

The coded reception strength signal, generated by the signal generator 112, is provided to a display 116 located in the vicinity of the antenna 104.

At the antenna site 114, coupled to the cable 110, a low frequency signal receiver 118 receives the low frequency reception strength signal. The low frequency signal receiver 118 decodes the low frequency signal into a value that is presented on the display 116 collocated with the antenna site 114. The display is located where it is visible to a person who is adjusting the antenna. In certain embodiments, the display 116 is a multi-segment LED or LCD digital readouts. In other embodiments, the display 116 is a meter, having a needle pivoting at one end of the needle, sweeping out an angle corresponding to the signal strength. In other embodiments, the display 116 is a cross-hair video display 116 that directs the person adjusting the antenna 104 toward the proper alignment of an antenna 104 boresight with the transmitting satellite. In still other embodiments, the display 116 includes a series of lights, each light having a unique threshold corresponding to a signal strength level, each light turning and remaining on when a numerical value indicated by the coded signal exceeds a threshold. The display 116 and the low frequency signal receiver 118 can be integrated into one box.

In each of the exemplary embodiments of the invention, the reception signal strength information is presented on a display in a manner that is readily interpretable by the antenna installer at the antenna mounting side. The displays of the different embodiments of the invention provide a quantifiable measure of the reception signal strength to the antenna installer. This permits the installer to make precise adjustments of the antenna positioning to maximize the reception signal strength.

In the exemplary embodiment, the low frequency signal is a balanced signal, i.e., a signal having no overall d.c. component. The low frequency signal employs a balanced binary coding to encode a characteristic of the signal seen at the television, and provide information regarding the quality of the image to the display. Examples of balanced binary coding are presented in the following table; however, it will be apparent that the following examples are not limiting since any balanced code, and even more generally any code whether balanced or not, may be used in conjunction with the low frequency signal without departing from the present invention. An example of a suitable coding technique includes NRZ (non-return to zero) coding.

| digital value | 4B/5B coding: 5B/6B coding |
|---|---|
| 0 | 000111 |
| 1 | 001011 |
| 2 | 001101 |
| 3 | 001110 |

-continued

| digital value | 4B/5B coding: 5B/6B coding |
|---|---|
| 4 | 010011 |
| 5 | 010101 |
| 6 | 010110 |
| 7 | 011001 |
| 8 | 011010 |
| 9 | 011100 |
| 10 | 100011 |
| 11 | 100101 |
| 12 | 100110 |
| 13 | 101001 |
| 14 | 101010 |
| 15 | 101100 |
| 16 | 110001 |
| 17 | 110010 |
| 18 | 110100 |
| 19 | 111000 |

Balanced coding allows for the average d.c. component to remain zero over time. In the above-described embodiment, the low frequency signal propagating through the cable 110 from the signal generator 112 does not interfere with the signal from the antenna 104 propagating to the set-top box 102, due to frequency separation.

The value encoded in the low frequency signal is directly related to the signal strength of the DSS signal received at the set-top box 102. In certain embodiments, the low frequency signal is a digital value representing a percentage of the theoretical maximum signal strength the antenna 104 is able to receive. In other embodiments, the low frequency signal is a digital value representing the power of the DSS signal received at the set-top box 102. In other embodiments, the low frequency signal represents statistical correlation values between one video frame and the next. In still other embodiments, the signal is an analog signal proportional to the amplitude of the envelope (fundamental) of the DSS signal. Other representations of signal strength, power, statistical or stochastic correlation or coherence, or other indications of the quality of reception that might aid a person in pointing an antenna 104 will be apparent to one skilled in the art upon reference to the present invention.

With the present invention, the antenna installer at the site of the antenna is able to precisely adjust the satellite dish receiver position since the installer has a quantifiable measure of the reception signal strength. Adjustment of the antenna position will either increase or decrease the displayed signal strength indication, as provided by the coded signal generated by the set-top box 102. The installer will then move the antenna in a precise manner to maximize the signal strength.

Although described in terms in various embodiments, the present invention is not limited by the above description, which is presented by way of example and not by way of limitation.

What is claimed is:

1. A method for positioning a satellite antenna, comprising the steps of:

receiving a satellite signal at a satellite antenna and forwarding the satellite signal to a signal receiver remote from the satellite antenna;

conditioning the satellite signal at the signal receiver to create a signal for display on a television;

determing the strength of the satellite signal at the signal receiver and generating a quantitative signal strength value representative of the strength of the received satellite signal;

coding the signal strength value as a non-return to zero signal and forwarding the signal strength value as a low frequency signal from the signal receiver to a display at the satellite antenna;

converting the low frequency signal into a numerical display value and displaying the signal strength value on the display at the satellite antenna; and adjusting the position of the satellite antenna as a function of the displayed signal strength value to maximize the strength of the received satellite signal.

* * * * *